US008071664B2

(12) United States Patent
Aufderheide et al.

(10) Patent No.: US 8,071,664 B2
(45) Date of Patent: Dec. 6, 2011

(54) COMPOSITIONS CONTAINING CERTAIN METALLOCENES AND THEIR USES

(75) Inventors: Ronald C. Aufderheide, Delaware, OH (US); Michael T. Brown, Delaware, OH (US); Jorg Kroker, Powell, OH (US); Xianping Wang, Dublin, OH (US)

(73) Assignee: ASK Chemicals L.P., Wilmington, DE (US)

( * ) Notice: Subject to any disclaimer, the term of this patent is extended or adjusted under 35 U.S.C. 154(b) by 389 days.

(21) Appl. No.: 12/321,778

(22) Filed: Jan. 26, 2009

(65) Prior Publication Data

US 2009/0199991 A1 Aug. 13, 2009

Related U.S. Application Data

(60) Provisional application No. 61/063,157, filed on Jan. 31, 2008.

(51) Int. Cl.
*B22C 1/00* (2006.01)

(52) U.S. Cl. ..... 523/139; 523/143; 523/131; 164/5; 164/17; 164/229

(58) Field of Classification Search ..... 523/139
See application file for complete search history.

(56) References Cited

U.S. PATENT DOCUMENTS

| | | | | |
|---|---|---|---|---|
| 4,070,212 | A | 1/1978 | Mackey et al. | |
| 4,076,657 | A | 2/1978 | Kracklauer | |
| 5,102,918 | A | 4/1992 | Moriya | |
| 5,602,192 | A * | 2/1997 | Yoshida et al. | 523/145 |
| 5,746,784 | A | 5/1998 | Thunker et al. | |
| 5,872,328 | A | 2/1999 | Menke et al. | |
| 6,133,340 | A * | 10/2000 | Menon | 523/139 |
| 6,647,888 | B1 | 11/2003 | Cesaroni et al. | |
| 6,776,606 | B2 | 8/2004 | Haskew | |
| 6,948,926 | B2 | 9/2005 | Valentine et al. | |
| 6,971,337 | B2 * | 12/2005 | Guinther et al. | 123/1 A |
| 7,022,196 | B2 | 4/2006 | Cesaroni et al. | |
| 2004/0069434 | A1 * | 4/2004 | Showman et al. | 164/17 |
| 2005/0016711 | A1 | 1/2005 | Aufderheide et al. | |

OTHER PUBLICATIONS

T. T. Nguyen, "The Effects of Ferrocenic and Carborane Derivative Burn Rate Catalysts in AP Composite Propellant Combustion: Mechanism of Ferrocene-Catalysed Combustion", Weapons Systems Division of Aeronautical and Maritime Research Laboratory, DSTO-TR-0121 (Abstract attached).

* cited by examiner

*Primary Examiner* — Doris Lee
(74) *Attorney, Agent, or Firm* — Standley Law Group LLP

(57) ABSTRACT

Compositions comprising (1) a refractory and/or a binder, and (2) bis-cyclopentadienyl iron cyclopentadienyl manganese tricarbonyl, derivatives thereof, and mixtures thereof.

10 Claims, No Drawings

COMPOSITIONS CONTAINING CERTAIN METALLOCENES AND THEIR USES

BACKGROUND

In the foundry industry, one of the procedures used for making metal parts is "sand casting". In sand casting, disposable foundry shapes, e.g. molds, cores, sleeves, pouring cups, coverings, etc. are fabricated with a foundry mix that comprises a mixture of a refractory and an organic or inorganic binder. The foundry shape may have insulating properties, exothermic properties, or both.

Foundry shapes such as molds and cores, which typically have insulating properties, are arranged to form a molding assembly, which results in a cavity through which molten metal will be poured. After the molten metal is poured into the assembly of foundry shapes, the metal part formed by the process is removed from the molding assembly. The binder is needed so the foundry shapes do not disintegrate when they come into contact with the molten metal. In order to obtain the desired properties for the binder, various solvents and additives are typically used with the reactive components of the binders to enhance the properties needed.

Foundry shapes are typically made by the so-called no-bake, cold-box processes, and/or heat cured processes. In the no-bake process, a liquid curing catalyst is mixed with an aggregate and binder to form a foundry mix before shaping the mixture in a pattern. The foundry mix is shaped by compacting it in a pattern, and allowing it to cure until it is self-supporting. In the cold-box process, a volatile curing catalyst is passed through a shaped mixture (usually in a corebox) of the aggregate and binder to form a cured foundry shape. In the heat cured processes the shape mixture is exposed to heat which activates the curing catalyst to form the cured foundry shape.

There are many requirements for a binder system to work effectively. For instance, the binder typically has a low viscosity, be gel-free, and remain stable under use conditions. In order to obtain high productivity in the manufacturing of foundry shapes, binders are needed that cure efficiently, so the foundry shapes become self-supporting and handleable as soon as possible.

With respect to no-bake and heat cured binders, the binder typically produces a foundry mix with adequate worktime to allow for the fabrication of larger cores and molds. On the other hand, cold-box binders typically produce foundry mixes that have adequate benchlife, shakeout, and nearly instantaneous cure rates. The foundry shapes made with the foundry mixes using either no-bake, cold-box or heat cured binders typically have adequate tensile strengths (particularly immediate tensile strengths), scratch hardness, and show resistance to humidity.

One of the greatest challenges facing the formulator is to formulate a binder that will hold the foundry shape together after is made so it can be handled and will not disintegrate during the casting process,[1] yet will shakeout from the pattern after the hot, poured metal cools. Without this property, time consuming and labor intensive means must be utilized to break down the binder so the metal part can be removed from the casting assembly. Another related property required for an effective foundry binder is that foundry shapes made with the binder must release readily from the pattern.

Casting temperatures of poured metal reach 1500° C. for iron and 700° C. for aluminum parts.

The flowability of a foundry mix made from sand and an organic binder can pose greater problems with respect to cold-box applications. This is because, in some cases, the components of the binder, particularly the components of phenolic urethane binders, may prematurely react after mixing with sand, while they are waiting to be used. If this premature reaction occurs, it will reduce the flowability of the foundry mix and the molds and cores made from the binder will have reduced tensile strengths. This reduced flowability and decrease in strength with time indicates that the "benchlife" of the foundry mix is inadequate. If a binder results in a foundry mix without adequate benchlife, the binder is of limited commercial value.

In view of all these requirements for a commercially successful foundry binder, the pace of development in foundry binder technology is gradual. It is not easy to develop a binder that will satisfy all of the requirements of interest in a cost-effective way. Also, because of environmental concerns and the cost of raw materials, demands on the binder system may change. Moreover, an improvement in a binder may have some drawback associated with it. In view of these requirements, the foundry industry is continuously searching for new binder systems that will reduce or eliminate these drawbacks.

Although there has been tremendous progress in the development of foundry binder systems, there are still problems associated with the use of organic binder systems. Of particular concern are problems associated with the by-products that are generated from the actual decomposition of the binders. These problems include casting defects such as warpage, scabs, erosion, lustrous carbon, carbon pickup, and rattails caused by the expansion of the sand and loss of strength of the binder. Various additives such as iron oxides and various blends of clays, sugar, and cereals are used to help to minimize or eliminate many of these defects. However, the use of specialty sands and sand additives only addresses the types of defects associated with the expansion of the sand and cooling of the metal.

Additionally, the use of these additives can cause other problems such as reduced strengths within the core or mold, gas defects and smoke caused by the additional gasses coming from the organic additives. Furthermore, additives can affect the ability of the binder to create a strong core, mold, or other shapes because they either soak up some of the binder or introduce large amounts of fine particles which add to the surface area that the binder needs to coat which, either way, effectively reduces the strength of the overall mixture. The use of an additional binder can overcome the strength losses caused by the use of traditional additives but this can in turn increase the presence of defects related to the decomposition products of the binder system such as gas defects, smoke, lustrous carbon, and carbon pickup in the metal. Without the additional binder to compensate for the loss of strength when using the traditional additives, other defects such as erosion, warpage, scabs, and rattail defects can be exacerbated.

Examples of foundry shapes that may be required to have exothermic properties include, for example, sleeves, floating coverlids, and coverings or pads for other parts of the casting and/or gating system. Exothemmic foundry mixes used to make these foundry shapes comprise a refractory, an oxidizable metal, a compound that is a source of oxygen, and typically an initiator for the exothermic reaction. Exothermic foundry mixes are also used for materials such as powdered hot toppings and other materials where a bonding agent is not applied and there is no curing of the material.

Foundries use exothermic materials and shapes having exothermic properties to keep the molten metal, used to prepare metal parts, in its liquid state longer, so that premature solidification of the metal does not occur. Although conventionally used exothermic materials and shapes having exothermic properties are effective, there is a need to provide new materials that impart improved exothermic properties to the foundry materials and shapes having exothermic properties. In particular, there is a need for exothermic foundry mixes that provide improved exothermic properties without adversely affecting other exothermic properties. There is also a need to provide exothermic foundry mixes that allow the formulator to customize the formulation for the preparation of specific metal parts.

More specifically, it is important to control the amount of energy that it takes to start the exothermic reaction. Ideally, one wants to use the least amount of energy to start the exothermic reaction needed for the particular application, yet maximize the burn temperature, total amount of energy released, and maintain the exothermic material burn as hot as possible for as long as possible.

If one uses the exothermic foundry mixes known in the prior art, there is a limit as to how the formulator can customize the exothermic foundry mixes for the preparation of specific metal castings. For instance, if the formulator wants the exothermic reaction to initiate using less energy, then you have to use a finer particle size of aluminum. However, if the formulator does this, then the duration of the exothermic reaction and the maximum temperature reached are adversely affected. On the other hand, if the formulator uses a larger particle size of aluminum to increase the duration of the exothermic reaction and increase the maximum temperature, the energy to ignite is higher. Because of this, foundries often use a blend of two different particle sizes of aluminum, but it is apparent that this result is not completely satisfactory.

SUMMARY

The disclosure relates to compositions comprising (1) a refractory and/or a binder, and (2) bis-cyclopentadienyl iron, cyclopentadienyl manganese tricarbonyl, derivatives thereof, and mixtures thereof.

One aspect of the disclosure relates to refractory compositions. Another aspect of the disclosure relates to refractory-free binder compositions.

The refractory compositions comprise a refractory and a metallocene selected from the group consisting of bis-cyclopentadienyl iron, cyclopentadienyl manganese tricarbonyl, derivatives thereof, and mixtures thereof. The refractory compositions are particularly useful in foundry applications.

The refractory compositions are used in free-flowing powders where no binder is applied, e.g. hot toppings used in foundry applications. In other applications, particularly foundry applications, the refractory compositions further comprise a binder. When the refractory compositions contain a binder, they are typically used to make foundry shapes, e.g. molds, cores, and sleeves. Foundry shapes with exothermic properties can be prepared by adding an oxidizable metal and a compound that is a source of oxygen to the refractory composition. In foundry applications, the exothermic refractory composition may also contain, among other components, an initiator for the exothermic reaction.

The refractory-free binder compositions comprise a binder and a metallocene selected from the group consisting of bis-cyclopentadienyl iron, cyclopentadienyl manganese tricarbonyl, derivatives thereof, and mixtures thereof. The refractory-free binder compositions may be mixed with a refractory after they are formulated and used for foundry applications or even non-foundry applications. Non-foundry applications may contain non-refractory materials, e.g. filler, wood, fiber, etc. and can be used in composites, plastics, flooring, panels, etc. In these applications it is important to also maintain the highest strength properties possible while maintaining the performance characteristics of the final material that are required by its end use. This would include the material's resistance to scratches, flexibility, crack resistance, overall toughness, adhesive strength, flexibility, and/or humidity resistance.

The use of the metallocene in the compositions provides one or more of the following advantages:

(a) reduces the amount of lustrous carbon on the surface of a casting;
(b) reduces the amount of carbon pickup into the metal at the casting/mold interface;
(c) reduces the amount of visible smoke that the binder generates during decomposition;
(d) improves the exothermic reaction in exothermic sleeves;
(e) reduces the Hazardous Air Pollutants (DPAP's) from the decomposition of the binder; and/or
(f) improves the hot strength of a binder refractory mix as evidenced by results of warpage and hot strength tests.

When using exothermic refractory compositions, e.g. exothermic foundry mixes, containing a metallocene, one can customize the exothermic refractory compositions to prepare specific metal parts and produce foundry shapes that have improved exothermic properties. By using an appropriate amount of ferrocene compound for the particular casting operation, the energy needed to ignite the exothermic reaction can be adjusted without adversely affecting the other exothermic properties of the foundry shape, e.g. maximum burn temperatures, duration of the exotherm, and total energy released. In fact, applicants found that in many instances these properties are also improved. Additionally, the burn rate of the foundry shape can be tailored to the particular situation. Furthermore, one can reduce the overall cost of raw materials, e.g. one can use less aluminum to achieve exothermic temperatures equivalent to those using known exothermic exothermic refractory compositions.

The amount of metallocene used is sufficiently low, so that the advantages can be achieved economically. This is in contrast to the use of other typical sand additives, which are used to improve casting properties, e.g. iron oxide. Because the metallocenes are soluble in the resin and in the solvents that are used in the resins, they are easier to use and are easy to introduce into the mix. Their use also eliminates the problems associated with the use of additives that actually absorb some of the binder and thus reduce strengths.

Using a metallocene also eliminates the need for a powder feeder to deliver the additive since it can simply be included in the binder or catalyst of the resin system.

DEFINITIONS

BOB: based on binder.

BOS: based on sand.

Casting assembly: an assembly of casting components such as pouring cup, downsprue, gating system, molds, cores, risers, sleeves, etc. which are used to make a metal casting by pouring molten metal into the casting assembly where it flows to the mold assembly and cools to form a metal part.

Downsprue: main feed channel of the casting assembly through which the molten metal is poured.

Foundry shape: shape used in the casting of metals, e.g. molds, cores, sleeves, pouring cups, floating coverlids, coverings or pads for other parts of the casting and/or gating system, and the like.

Gating system: system through which metal is transported from the pouring cup to the mold and/or core assembly. Components of the gating system include the downsprue, runners, choke, ingates, etc.

Handleable: a foundry shape that one can transport from one place to another without having it break or fall apart.

HAPS: hazardous air pollutants, e.g. benzene, toluene, and xylene.

ISOCURE® Part I 492: the phenolic resin component of a phenolic urethane cold-box binder system sold by Ashland Performance Materials, a division of Ashland Inc.

ISOCURE® Part II 892: the polyisocyanate component of a phenolic urethane cold-box binder system sold by Ashland Performance Materials, a division of Ashland Inc. The weight ratio of Part I to Part II is typically 55:45.

Mold assembly: an assembly of mold components and/or cores made from a mixture of a foundry aggregate (typically sand) and a foundry binder, which are assembled together to provide a shape for the casting assembly.

PEP SET® Part I 747: the phenolic resin component of a phenolic urethane no-bake binder system sold by Ashland Performance Materials, a division of Ashland Inc.

PEP SET® Part II 847: the polyisocyanate component of a phenolic urethane no-bake binder system sold by Ashland Performance Materials, a division of Ashland Inc. The weight ratio of Part I to Part II is typically 55:45.

DETAILED DESCRIPTION

The formulator of the composition can mix the components of the composition in a variety of ways and sequences. Typically, the metallocene is pre-blended with the refractory and/or the binder, but can also be added as a separate component to the composition.

When formulating an exothermic refractory composition, if the materials are pre-blended prior to adding the bonding resin, it is advisable, for safety reasons, to keep the oxygen source and oxidizable metal separated from the initiator. This avoids the potential of having an extremely large concentration of the initiator in contact with the oxygen source and oxidizable metal, which could cause a premature reaction. Otherwise, the mixing sequence is of little significance. One typically adds the refractory to a mixer followed by or along with the oxidizable metal. Then one adds the compound that is a source of oxygen followed by the initiator if an initiator is used.

One may use any refractory known in the foundry art to make foundry mixes. Examples include, for example silica, magnesia, alumina, olivine, chromite, zircon, aluminosilicate and silicon carbide among others. These refractories are available in a variety of shapes from round to angular to flake to fibers, etc. One may also use refractory materials that have insulating properties when compared to the refractories listed above in the foundry mix. Examples of such insulating refractories include aluminosilicate fibers and microspheres.

The refractory is used in a major amount, typically at least 85 parts by weight of the composition, more typically at least 90 parts by weight, and most typically at least 95 parts by weight, where said parts by weight are based upon 100 parts by weight of the composition. The other components of the composition are used individually in minor amounts, typically less than 15 parts by weight, more typically less than 10 parts by weight, and most typically less than 5 parts by weight, where said parts by weight are based upon 100 parts by weight of the composition.

The refractory-free binder compositions may contain a non-refractory materials, e.g. a filler, wood, fiber, etc. and used in composites, plastics, flooring, panels, etc. Typically these filler materials are used in lower quantities compared to the foundry refractory materials. The fillers are typically used in levels less than 50% and more typically less than 30%.

Binders used in the refractory compositions and binder compositions include epoxy-acrylic, phenolic urethane, aqueous alkaline phenolic resole resins cured with methyl formate, silicate binders cured with carbon dioxide, polyester polyols, unsaturated polyester polyols. The amount of binder used depends upon the particular application, but is typically a minor amount of the composition, most typically from about 0.5 part to about 10 parts by weight based upon the weight of the total composition. For non-foundry applications the amount of the binder is a major portion of the composition, most typically form about 50 parts to over 90 parts by weight based on the weight of the total composition.

The oxidizable metal used in exothermic refractory compositions is typically aluminum, although one may also use magnesium, silicon, and other similar metals. When one uses aluminum metal as the oxidizable metal for an exothermic sleeve, the aluminum metal is typically used in the form of aluminum powder, aluminum granules, and/or flakes.

The oxidizing agent for the exothermic reaction used includes, for example, iron oxide, maganese oxide, potassium permanganate, potassium nitrate, sodium nitrate, sodium chlorate, and potassium chlorate, sodium peroxodisulfate, etc.

Initiators for the exothermic reaction include, for example, cryolite ($Na_3AlF_6$), potassium aluminum tetrafluoride, potassium aluminum hexafluoride, and other fluorine-containing salts.

Metallocenes that are used in the compositions are bis-cyclopentadienyl iron, whose chemical formula is $Fe(C_5H_5)_2$ and is known commonly as ferrocene, cyclopentadienyl manganese tricarbonyl, derivatives thereof, and mixtures thereof. Derivatives of ferrocene include polynuclear ferrocenes. Polynuclear ferrocene compounds are ferrocene compounds that contain more than one iron atom, individually located or bonded to each other. Examples of polynuclear ferrocene compounds include bis-μ(fulvalenediyl)diiron, cyclopentadienyl iron dicarbonyl (available as a dimer). Examples of derivatives of ferrocene include bis(η5-pentamethylcyclopentadienyl) iron and μ(fulvalenediyl)di(η5-cyclopentadienyl iron. An example of a derivative of cyclopentadienyl manganese tricarbonyl is methylcyclopentadienyl manganese tricarbonyl.

When formulating the compositions, one needs to consider the effectiveness of using various levels of the metallocene, particularly when used in exothermic refractory compositions. Low levels of metallocene in an exothermic foundry mix (from 0.05 part to 10 parts by weight based upon the total weight of the exothermic refractory composition) improve the ignition of an exothermic reaction, but too much metallocene (above 10 parts by weight based upon the total weight of the exothermic refractory compositions) can generate too much metal oxide (iron oxide when ferrocene or derivatives thereof are used) and will begin to act as a heat sink and retard or even stop the exothermic reaction.

Typically, the amount of metallocene in the composition ranges from about 0.0005 part by weight to about 4.0 parts by weight, where the weight is based upon 100 parts of the composition. More typically the amount of metallocene ranges from about 0.002 parts by weight to about 0.5 parts by weight, and most typically from 0.006 parts by weight to 0.2 parts by weight.

In exothermic refractory compositions, the amounts of the various components typically range from 40 to 90 parts by weight of refractory, 5 to 30 parts by weight of oxidizable metal, 2 to 10 parts by weight of a compound which is a source of oxygen, 2 to 10 parts by weight of an initiator for the exothermic reaction, and 0.001 part by weight to 4.0 parts by weight of a metallocene, where said parts by weight are based upon 100 parts by weight of exothermic refractory composition. Preferably, the amounts range from 50 to 70 parts by weight of refractory, 10 to 30 parts by weight of oxidizable metal, 3 to 7 parts by weight of a compound which is a source of oxygen, 3 to 6 parts by weight of an initiator for the exothermic reaction, and about 0.006 part by weight to about 1.0 part by weight of a metallocene or a derivative thereof, where said parts by weight are based upon 100 parts by weight of exothermic refractory composition.

Foundry shapes are prepared from foundry mixes by mixing the foundry mix with a foundry binder and/or water. This mix is then shaped by introducing it into a pattern by methods well-known in the foundry art, e.g. "ramming", "vacuuming", "blowing or shooting", the "cold-box process", the "no-bake process", "the warm-box process" and the "hot-box process".

The amount of binder used is an amount which is effective to maintain the shape of the foundry shape and allow for effective curing, i.e. which will produce a sleeve which can be handled or self-supported after curing. Typically, the amount effective for accomplishing these functions is an amount of from about 0.5 weight percent to 14 weight percent, based upon the weight of the exothermic foundry mix. More typically, the amount of binder ranges from about 1.0 weight percent to about 12 weight percent. The amount used will depend upon the density of the foundry mix and whether insulating or exothermic properties are desired. Higher density mixes generally require less binder and lighter foundry mixes generally require more binder by weight.

Ramming involves packing a mixture of a foundry mix and binder into a pattern made of wood, plastic, and/or metal. Vacuuming involves applying a vacuum to aqueous slurry of the refractory and suctioning off excess water to form a foundry shape. Blowing involves blowing the foundry mix and binder into a pattern. Typically, when the process used to form the foundry shape involves vacuuming aqueous slurry, in order cure the foundry shape, the foundry shape is oven-dried to further remove excess water left behind after the foundry shape is removed from the pattern and to allow the binder to completely cure more rapidly. If the contained water is not removed, it may vaporize when it comes into contact with the hot metal and result in a safety hazard and possibly casting defects. When the foundry shape is formed by ramming, or blowing, the shape is cured after it is formed in the pattern.

The foundry shapes can be cured with a curing catalyst according to the cold-box, no-bake, hot-box, and warm-box processes, and any other processes known in the foundry art to cure foundry shapes with a catalyst. In these processes, a pattern is filled with the foundry mix and foundry binder. In some processes, this mixture also contains a liquid curing catalyst (e.g. the no-bake process), or in some processes the foundry shape is contacted with a vaporous curing catalyst after the foundry mix and foundry binder are blown into the pattern (e.g. the cold-box process). The particular refractories, binders, catalysts, and procedures used in the cold-box, no-bake, hot-box, and warn-box processes are well known in the foundry art. Examples of such binders are phenolic resins, phenolic urethane binders, furan binders, alkaline phenolic resole binders, and epoxy-acrylic binders among others.

Foundry shapes are prepared by a cold-box process comprising:

(a) introducing a major amount of a foundry mix into a pattern to form a foundry shape;
(b) contacting the foundry mix in the pattern with a vaporous curing catalyst;
(c) allowing the foundry shape to cure; and
(d) removing the foundry shape from the pattern when it is handleable.

Typically used as binders in the cold-box process are epoxy-acrylic and phenolic urethane cold-box binders. The phenolic urethane binders are described in U.S. Pat. Nos. 3,485,497 and 3,409,579, which are hereby incorporated into this disclosure by reference. These binders are based on a two-part system, one part being a phenolic resin component and the other part being a polyisocyanate component. The epoxy-acrylic binders are cured with sulfur dioxide in the presence of an oxidizing agent are described in U.S. Pat. No. 4,526,219 which is hereby incorporated into this disclosure by reference.

Other cold-box binders include aqueous alkaline phenolic resole resins cured with methyl formate, described in U.S. Pat. Nos. 4,750,716 and 4,985,489, which are hereby incorporated into this disclosure by reference, and silicate binders cured with carbon dioxide, described in U.S. Pat. No. 4,391,642, which is hereby incorporated into this disclosure by reference.

Foundry shapes are prepared by a no-bake process comprising:

(a) introducing a major amount of foundry mix containing a liquid curing catalyst into a pattern to form a foundry shape;
(b) allowing the foundry shape to cure; and
(c) removing the foundry shape from the pattern when it is handleable.

Curing the sleeve by the no-bake process takes place by mixing a liquid curing catalyst with the resin and foundry mix, shaping the sleeve mix containing the catalyst, and allowing the shape to cure, typically at ambient temperature without the addition of heat. Typically used as binders in the no-bake process are phenolic urethane binders, furan binders, and aqueous alkaline phenolic resole resins.

The preferred liquid curing catalyst for the phenolic urethane binders is a tertiary amine and the preferred no-bake curing process is described in U.S. Pat. No. 3,485,797 which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine.

Metal parts are prepared by a process for casting a metal part comprising:

(a) inserting a foundry shape into a casting assembly having a mold assembly;
(b) pouring metal, while in the liquid state, into said casting assembly;
(c) allowing said metal to cool and solidify; and
(d) then separating the cast metal part from the casting assembly.

The metal poured may be a ferrous or non ferrous metal.

Examples of Test Cores Made with No Exothermic Materials by the Cold Box Process Using Ferrocene One hundred parts of binder (ISOCURE®492/892) are mixed with Manley 1L5W Lake sand such that the weight ratio of Part I to Part II was 55/45 and the binder level was 1.5 weight percent based on the weight of the sand. The Part I was added to the sand first, then the Part II was added. In the Control mix, no ferrocene was added to the foundry mix, while in Example 1, 1 weight percent ferrocene, based upon the weight of the Part I, was added to Part I of the binder. The resulting foundry mix is forced into a dogbone-shaped test corebox by blowing it into the corebox. The shaped mix in the corebox is then contacted with TEA at 20 psi for 2 seconds, followed by a 10 second nitrogen purge at 40 psi., thereby forming AFS tensile strength samples (dog bones) using the standard procedure.

Warpage Test on Test Cores

Warpage test were conducted on the test cores by using a "Warpage Block" to determine the effects of the flow of molten metal and heat on the binder used to make the test cores. A Warpage Block is mold assembly consisting of a 2.5 or 3.5 inch thick block within which three cores (½"×1"×10") are inserted. To conduct the warpage test, molten iron metal, is poured into the mold assembly at 1550 degrees Fahrenheit through a downsprue where it eventually flows over and around cores and solidifies. During the process, the cores may "warp," i.e. lose their dimensionally accuracy. After the molten metal solidifies, the resulting castings are cut up into sections where the deflection of the cores from a centerline are measured and recorded. The results of the warpage tests are shown in Table I.

TABLE I

| Warpage Test | | |
|---|---|---|
| Mix # | Control | Example. 1 |
| Additive | None | 1% Ferrocene |
| Warpage (in.) | 0.08 | 0.03 |

The warpage was drastically reduced from 0.08" to 0.03" when ferrocene based on the weight of the Part I. The numbers in the Table I were an average of three tests.

Lustrous Carbon Test on Stainless Steel Casting Made with Test Cores Prepared by a No-Bake Process A 3" cube casting was poured in a low carbon 304L stainless steel with a base carbon of 0.035%. The molds were made using a phenolic urethane no-bakebinder system, 1% PEP SET® I 747/II 847 at a 55/45 ratio. The carbon content on the surface of each of the 3" cube castings were compared. Table II sets forth the amount of carbon on the surface of each casting.

TABLE II

| Carbon pick up test | | |
|---|---|---|
| Example | Amount of additive | Carbon content at surface of casting |
| Control | 0 | 0.140 |
| Example A | 3% iron oxide (BOS) | 0.036 |
| Example 1 | 0.000075% ferrocene (BOS) | 0.060 |
| Example 2 | 0.000075% ferrocene (BOS) | 0.054 |
| Example 3 | 0.00015% ferrocene (BOS) | 0.092 |

Traditionally iron oxide is used to reduce the carbon pick up in steel castings as shown in Example A. The carbon content at the surface of the casting was drastically reduced from a surface content of 0.14% carbon down to 0.036% carbon when 3% iron oxide (based on the sand weight) was used (mixed in the sand mix). As the data in Table II show, the use of minor amounts of ferrocene, compared to the amount of iron oxide, reduced the amount of carbon pick on the surface of the casting significantly. Furthermore, it did not appear to make much of a difference if the ferrocene was mixed in with the sand or if it was pre-blended into the binder itself.

Even though the use of ferrocene does not appear to burn the binder faster, it does appear to affect the carbon decomposition products and this can be seen by the improvement/reduction in the amount of lustrous carbon formed on gray iron castings and by the reduction in carbon pickup in steel castings. The reduction in black smoke is also noticeable.

Haps (Hazardous Air Pollutants) Test Using Test Cores Prepared by Cold Box Process A CoGas machine, manufactured by mk Industrievertretungen, was used to simulate the casting of a metal part. When using a CoGas machine, a core is dipped into molten aluminum metal resulting in the escape of decomposition products from the binder. The test was used to collect the binder decomposition products of an ISOCURE® 492/892 binder used to make the cores used in the test.

The decomposition products were collected and analyzed. The capture efficiency for the decomposition products for this test was 200 mg/g of binder, which is about four times better that the traditional hood stack test. The total hydrocarbon capture was estimated at 90%.

Test results showed that the addition of 0.015 parts ferrocene to 100 parts of sand mix resulted in a HAPS reduction of 20% for the core when compared to a core made with a sand mix that did not contain ferrocene.

Hot Compressive Strength Test Using Test Cores Prepared by Cold Box Process

Hot compressive strength tests were run on 1" diameter by 2" tall test cores using a dilatometer. Two test cores were made with an ISOCURE® 492/892 binder in a manner similar to that set forth in Example 1, one without ferrocene and one made by adding 0.015 part ferrocene per 100 parts sand mix.

An initial force of 10 newtons per meter was applied to the test core and a furnace having a temperature of 1,100° C. was lowered down around the test core. The load was increased while the percent deformation was monitored.

The test results indicate that the test core made without ferrocene reached an ultimate load of 68 N/m with a deformation of just over 4%. On the other hand, the ultimate load of the test core made with a foundry mix containing the ferrocene was just above 50 N/m, but the data indicate that the load for this test core was held for a longer time and over a higher amount of deformation. This indicates that the sample, which contained the ferrocene, had an overall higher hot strength.

SUMMARY OF TESTS

The test data on cores produced using ferrocene in the foundry mixes clearly show that cores made with a foundry mix containing ferrocene display several advantages or improvements. The tests indicate that foundry shapes made with ferrocene show reduced warpage and that lesser amounts of HAPS will be generated during the casting process if a foundry mix containing ferrocene is used to make the foundry shape. Additionally, the tests show that the castings produced with molds and cores that contain ferrocene will have less lustrous carbon build generated and reduced carbon pick up at the surface of the casting.

EXAMPLES USING EXOTHERMIC FOUNDRY MIXES

Several exothermic foundry mixes were prepared by premixing the powdered and granular materials in a batch mixer for two minutes, followed by the addition of the binders which were mixed for an additional two minutes. Table III shows the amounts of the various components used to prepare the exothermic foundry mixes. The amounts of the components are expressed as percentage by weight based upon the total weight of the exothermic foundry mix. The exothermic foundry mixes were then mixed with 10 weight percent of a phenolic urethane cold box binder, ISOCURE® Part I 492 phenolic resin component and ISOCURE® Part II 892 polyisocyanate component, where the total weight percent of the foundry binder was based upon the total weight of the exothermic foundry mix. Test samples were prepared by shaping the exothermic foundry mixes. The shapes were cured by the cold-box process using triethyl amine as the curing catalyst.

The properties of the exothermic foundry mixes are shown in the bottom half of Table III. Mix A and B do not contain ferrocene and are shown for comparison purposes.

Ignition tests were conducted on test samples made by the cold-box process from several exothermic mixes as described in Table III. The ignition tests were run by placing test cores in a furnace at 1100° C. and monitoring the ignition periodically using an infrared thermometer, which generates a graph plotting temperature as a function of time.

The relevant exothermic properties are then calculated from the graphical data, which show the change in temperature over time. Time to ignition is the time necessary for the temperature to cross the baseline, which is the temperature of the cup in the furnace prior to the placement of the sample in the cup. The duration of the exotherm is the time the temperature remains above the baseline. Maximum temperature is the maximum temperature shown on the graph, and the energy released is the area between the baseline and the curve on the graph showing the variations in temperature over time.

TABLE III

| Component in weight % | Mix A (comparison using standard exothermic) | Mix B (comparison) using aluminum # 2) | Mix 1 With 0.5% Ferrocene (pre-mixed into Part I of the binder) | Mix 2 With 1.0% Ferrocene (pre-mixed into Part I of the binder) | Mix 3 With 2.0% Ferrocene (pre-mixed into Part I of the binder) |
|---|---|---|---|---|---|
| Microspheres | 68% | 68% | 67.5% | 67% | 66% |
| Aluminum | 24% | 24% | 24% | 24% | 24% |
| Iron Oxide | 5% | 5% | 5% | 5% | 5% |
| Cryolite | 3% | 3% | 3% | 3% | 3% |
| Ferrocene | 0% | 0% | 0.5% | 1% | 2% |
| Binder (%) | 10% | 10% | 10% | 10% | 10% |
| **Properties** | **Mix A** | **Mix B** | **Mix 1** | **Mix 2** | **Mix 3** |
| Time to Ignite (seconds) | 128.4 | 110.0 | 133.4 | 132.4 | 127.8 |
| Max Temperature (° C.) | 1130 | 1075 | 1136 | 1131 | 1151 |
| Duration of Burn (seconds) | 45 | 51.4 | 55.6 | 64.2 | 57.6 |
| Energy Released (calories) | 18090 | 13980 | 19340 | 22650 | 21350 |

Mix B uses a slightly finer aluminum, which results in a slightly faster ignition, but as Table III indicates, there are adverse effects to using the finer aluminum. For instance, the maximum temperature reached during the exothermic reaction is sacrificed and the exothermic reaction releases a lower amount of energy.

Regardless of whether the mixes containing the ferrocene are compared with Mix A or B, the mixes containing the ferrocene burn longer and release more energy. Furthermore, it is apparent that one can customize the exothermic foundry mixes by using an appropriate amount of ferrocene to obtain the desired maximum burn temperature, duration of the exotherm, and total energy released. By using ferrocene in the exothermic mix, the formulator can in some cases reduce the amount of initiator needed for the reaction. This enables the formulator to reduce the amount of fluorine in the exothermic formulation. Reducing the amount of fluorine in the exothermic mix typically has the effect of reducing the occurrence of fish-eye defects in ductile iron castings. Additionally, by using ferrocene in the exothermic mix, the formulator can in some cases reduce the total amount of fuel used in the exothermic mix, which would result in significant cost savings.

Ignition Tests on Foundry Mixes Containing Cyclopentadienyl Manganese Tricarbonyl (CMT)

A foundry mix is prepared using the components specified in Table IV. The microspheres, aluminum, oxidizers, ferrocene, and CMT are first mixed and then are mixed with the binder (ISOCURE® 492/892). In the Control, no ferrocene was added to the foundry mix. In MIXES 4 to 7 CMT was added to the foundry mix and MIX 8 both CMT and ferrocene were added to the foundry mix. The resulting foundry mixes are forced into a dogbone-shaped test corebox by blowing them into a corebox. The shaped mix in the corebox is then contacted with TEA at 20 psi for 2 seconds, followed by a 10 second nitrogen purge at 40 psi., thereby forming AFS tensile strength samples (dog bones) using a standard procedure.

Table IV identifies the components of the exothermic foundry mixes. The control does not contain CMT or ferrocene.

Ignition tests were conducted on test samples. The ignition tests were run by placing test cores in a furnace at 1100° C. and monitoring the ignition periodically using an infrared thermometer, which generates a graph plotting temperature as a function of time.

The relevant exothermic properties are then calculated from the graphical data, which show the change in temperature over time. Time to ignition is the time necessary for the temperature to cross the baseline, which is the temperature of the cup in the furnace prior to the placement of the sample in the cup. The duration of the exotherm is the time the temperature remains above the baseline. Maximum temperature is the maximum temperature shown on the graph, and the energy released is the area between the baseline and the curve on the graph showing the variations in temperature over time.

The results are shown at the bottom half of Table V.

TABLE IV (Ignition Test Results)

| | Control | MIX 1 | MIX 2 | MIX 3 | MIX 4 |
|---|---|---|---|---|---|
| Component of foundry mix in weight % | | | | | |
| Microspheres | 51.50% | 51.36% | 51.22% | 50.94% | 50.66% |
| Aluminum | 22% | 22% | 22% | 22% | 22% |
| Iron Oxide | 4.50% | 4.50% | 4.50% | 4.50% | 4.50% |

TABLE IV-continued (Ignition Test Results)

| | Control | MIX 1 | MIX 2 | MIX 3 | MIX 4 |
|---|---|---|---|---|---|
| Sodium Nitrate | 9% | 9% | 9% | 9% | 9% |
| Magnesium | 3% | 3% | 3% | 3% | 3% |
| Ferrocene | 0.00% | 0.00% | 0.00% | 0.00% | 0.28% |
| CMT | 0.00% | 0.14% | 0.28% | 0.56% | 0.56% |
| Binder (%) | 10% | 10% | 10% | 10% | 10% |
| Properties | | | | | |
| Time to Ignite (seconds) | 73.2 | 71.4 | 70.4 | 66.2 | 67 |
| Max Temperature (° C.) | 1012.5 | 1017.25 | 1022 | 1036.5 | 1039 |
| Duration of Burn (seconds) | 58.2 | 59.8 | 60.6 | 61.6 | 62.4 |
| Energy Released | 17712 | 18384.2 | 19080.8 | 21527 | 22713.4 |

The data indicate that as amounts of CMT increase, time to ignite decreases, maximum temperature reached increases, duration of burn increases, and energy released increases. The data with respect to MIX 4, which contains both CMT and ferrocene, indicate that there is an even greater improvement with respect to ignition.

The term "comprising" (and its grammatical variations) as used herein is used in the inclusive sense of "having" or "including" and not in the exclusive sense of "consisting only of." The terms "a" and "the" as used herein are understood to encompass the plural as well as the singular.

All publications, patents and patent applications cited in this specification are herein incorporated by reference, and for any and all purpose, as if each individual publication, patent or patent application were specifically and individually indicated to be incorporated by reference. In the case of inconsistencies, the present disclosure will prevail.

The foregoing description of the disclosure illustrates and describes the present disclosure. Additionally, the disclosure shows and describes only the preferred embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art.

The embodiments described hereinabove are further intended to explain best modes known of practicing it and to enable others skilled in the art to utilize the disclosure in such, or other, embodiments and with the various modifications required by the particular applications or uses. Accordingly, the description is not intended to limit it to the form disclosed herein. Also, it is intended that the appended claims be construed to include alternative embodiments.

The invention claimed is:

1. A process for preparing a foundry shape comprising the steps of:

forming a shape in a pattern from an amount of a refractory composition, the refractory composition comprising:

a major amount of a refractory;

a binder; and at least one of: cyclopentadienyl manganese tricarbonyl, derivatives thereof, and mixtures thereof, present in an amount of from about 0.0005 parts to about 4 parts by weight, based on the weight of the resulting refractory composition;

curing the formed shape; and removing the cured shape from the pattern as a foundry shape.

2. The process of claim 1, wherein the refractory composition further comprises:

5 parts by weight to 30 parts by weight of an oxidizable metal, 2 parts by weight to 10 parts by weight of a compound that is a source of oxygen.

3. The process of claim 2, wherein:

the refractory composition further comprises an initiator for an exothermic reaction.

4. The process of claim 1, wherein the curing step is effected by a curing catalyst.

5. The process of claim 1 wherein:

the binder is a phenolic urethane binder.

6. The process of claim 4, wherein:

the curing catalyst is a liquid catalyst that is mixed with the refractory composition prior to introducing the refractory composition into the pattern.

7. The process of claim 4, wherein:

the curing catalyst is a vaporous curing catalyst which contacts the formed shape.

8. The process of claim 7 wherein:

the catalyst is a vaporous amine curing catalyst.

9. A process for casting a metal part comprising:

inserting a foundry shape prepared in accordance with claim 1 into a casting assembly;

pouring metal, while in the liquid state, into said casting assembly;

allowing said metal to cool and solidify, resulting in a cast metal part; and separating the cast metal part from the casting assembly.

10. A process for preparing a foundry shape comprising the steps of:

forming a shape in a pattern from an amount of a refractory composition, the refractory composition comprising:

a major amount of a refractory;

a phenolic urethane binder; and at least one of: bis cyclopentadienyl iron, derivatives thereof, and mixtures thereof, present in an amount of from about 0.0005 parts to about 4 parts by weight, based on the weight of the resulting refractory composition;

curing the formed shape; and removing the cured shape from the pattern as a foundry shape.

* * * * *